United States Patent [19]

Kido et al.

[11] Patent Number: 4,555,464

[45] Date of Patent: Nov. 26, 1985

[54] AMORPHOUS SILICON ELECTROPHOTOGRAPHIC PHOTOSENSITIVE MATERIALS

[75] Inventors: Keishiro Kido; Hiroshi Sunagawa; Kazuhiro Kawajiri; Toshio Iijima; Nobuharu Nozaki, all of Kanagawa, Japan

[73] Assignee: Fuji Photo Film Co., Ltd., Kanagawa, Japan

[21] Appl. No.: 628,363

[22] Filed: Jul. 6, 1984

[30] Foreign Application Priority Data

Jul. 6, 1983 [JP] Japan ..... 58-122868

[51] Int. Cl.[4] ..... G03G 5/082; G03G 5/14

[52] U.S. Cl. ..... 430/67; 430/57; 430/66; 427/74; 252/501.1; 357/2

[58] Field of Search ..... 430/57, 66, 67; 427/74; 252/501.1; 357/2

[56] References Cited

U.S. PATENT DOCUMENTS

| | | | |
|---|---|---|---|
| 4,394,425 | 7/1983 | Shimizu et al. | 430/66 X |
| 4,452,875 | 6/1984 | Ogawa et al. | 430/57 |
| 4,465,750 | 8/1984 | Ogawa et al. | 427/74 X |
| 4,477,549 | 10/1984 | Fujimaki et al. | 430/66 X |

FOREIGN PATENT DOCUMENTS

| | | | |
|---|---|---|---|
| 57-115551 | 7/1982 | Japan | 430/67 |
| 57-115556 | 7/1982 | Japan | 430/67 |
| 58-88753 | 5/1983 | Japan | 430/57 |
| 58-159545 | 9/1983 | Japan | 430/57 |
| 58-159544 | 9/1983 | Japan | 430/57 |
| 58-159543 | 9/1983 | Japan | 430/57 |

*Primary Examiner*—Roland E. Martin

*Attorney, Agent, or Firm*—Sughrue, Mion, Zinn Macpeak & Seas

[57] ABSTRACT

An electrophotographic photosensitive material comprising a conductive support having thereon, in succession, a photoconductive layer composed of an amorphous material containing silicon atom and a barrier layer mainly composed of carbon and silicon, nitrogen and silicon, or oxygen and silicon, and further on the barrier layer a surface improvement layer having a composition of carbon and silicon of from 0.70/1 to 0.95/1 by atomic ratio in carbon/carbon+silicon, and the composition ratio being larger than that of the barrier layer.

7 Claims, No Drawings

AMORPHOUS SILICON ELECTROPHOTOGRAPHIC PHOTOSENSITIVE MATERIALS

FIELD OF THE INVENTION

This invention relates to electrophotographic photosensitive materials. More particularly, the invention relates to an improvement of an electrophotographic photosensitive material utilizing amorphous silicon as a photoconductive material.

BACKGROUND OF THE INVENTION

Hitherto, as photoconductive materials which are used for forming photoconductive layers of electrophotographic photosensitive materials, inorganic materials such as amorphous selenium, selenium alloys, metal compound semiconductors (e.g., oxides, sulfides, selenides, etc., of cadmium, zinc, etc.), organic polymers such as polyvinylcarbazole, etc., and organic compounds such as dyes, pigments, etc., have been known in the art, but a technique of using photoconductive amorphous silicon for the formation of photoconductive layers of electrophotographic photosensitive materials has recently been proposed.

Known methods of forming a photoconductive layer composed of amorphous silicon of an electrophotographic photosensitive material include a method of forming the photoconductive layer by dispersing powdery amorphous silicon in a binder and a method of decomposing a silicon-containing gas such as silane or a silane derivative by glow discharging and depositing the silicon thus formed on a conductive support. The electrophotographic photosensitive materials thus formed have as a fundamental structure a photoconductive layer composed of amorphous silicon containing silicon atom and a hydrogen atom and/or a halogen atom on a conductive support.

The amorphous silicon shows very fast dark decay, whereby the image density becomes lower, and, in extreme cases, it is sometimes difficult to obtain images. For improving these disadvantages of amorphous silicon, it is proposed to form on the photoconductive layer composed of amorphous silicon a surface barrier layer mainly composed of carbon and silicon as described in Japanese Patent Application (OPI) No. 115556/82 (the term "OPI" as used herein refers to a "published unexamined Japanese patent application"), a surface barrier layer mainly composed of nitrogen and silicon as described in Japanese Patent Application (OPI) No. 58160/82 (corresponding to U.S. Pat. No. 4,394,426), or a surface barrier layer composed mainly of oxygen and silicon as described in Japanese Patent Application (OPI) No. 63546/82 (corresponding to U.S. Pat. No. 4,409,308).

However, the electrophotographic photosensitive material having such a surface barrier layer has the disadvantage that the resolving power thereof is greatly reduced by the repeated application of corona discharging, in particular negative corona discharging under high temperature and high humidity conditions such as typically exist in summer weather. This disadvantage is particularly severe when the value of carbon/carbon+silicon (by atomic ratio) in the surface barrier layer mainly composed of carbon and silicon is less than 0.75.

SUMMARY OF THE INVENTION

The object of this invention is to eliminate the above-described disadvantages occurring in the case of forming a surface barrier layer on a photoconductive layer composed of amorphous silicon as described above. The practical object of this invention is to provide an electrophotographic photosensitive material causing no reduction of resolving power even when corona discharging is carried out under high temperature and high humidity conditions.

The object of this invention described above can be attained by the present invention. That is, according to this invention, there is provided an electrophotographic photosensitive material comprising a conductive support having disposed thereon, in succession, a photoconductive layer composed of an amorphous material containing silicon atom and a barrier layer mainly composed of carbon and silicon, nitrogen and silicon, or oxygen and silicon, and further having on the barrier layer a surface improvement layer having a composition of carbon and silicon having a carbon/carbon+silicon atomic ratio of from 0.70/1 to 0.95/1, and said atomic ratio being larger than that of the barrier layer.

DETAILED DESCRIPTION OF THE INVENTION

Reduction in resolving power of electrophotographic photosensitive material occurs at the case of repeatedly applying corona discharging on the photosensitive material under high temperature and high humidity conditions. Practically, according to this invention the reduction in resolving power occurring in the case of applying intermittent corona discharging of, for example, 40 times in 1 minute for 30 to 60 minutes can be completely prevented.

The surface improvement layer which is used in this invention can be formed, for example, in the following manner. A photosensitive material composed of amorphous silicon having a surface barrier layer is retained in a tightly closed container such as a bell jar, and three kinds of gases, i.e., hydrogen gas, a gas containing a silicon-containing compound (e.g., silane gas) and a gas containing a carbon atom-containing compound (e.g., hexafluoroethane) are introduced into the container at a flow ratio of from 40/4/40 to 40/40/40, and then glow discharging is performed on the surface of the surface barrier layer under high vacuum, whereby a surface improvement layer having a composition ratio carbon/carbon+silicon of 0.70 to 0.95 can be formed.

The thickness of the surface improvement layer is preferably from a thickness corresponding to a monomolecular layer to 30 μm, and more preferably is less than 3 μm. It is also preferred that the carbon/carbon+silicon ratio of the surface improvement layer be from 0.75 to 0.9.

The effect of this invention is particularly remarkable when the surface improvement layer of this invention contains therein a fluorine atom. The content of the fluorine atom is preferably from 1 to 30%, and more preferably from 1 to 10% of the total number of atoms. The fluorine atom can be introduced into the surface improvement layer by using a gas of or containing a fluoride as will be described below.

As the silicon atom-containing compound used in the case of forming the surface improvement layer in this invention, there are the silicon atom-containing compounds which can be used for forming the photoconductive layers in this invention as will be explained hereinafter.

Also, as the carbon atom-containing compound used for forming the surface improvement layer, there are hydrocarbons having from 1 to 5 carbon atoms, such as methane, ethane, propane, n-butane, isobutane, n-pentane, isopentane, ethylene, propylene, 1-butene, isobutylene, 1-pentene, 2-pentene, acetylene, methylacetylene, butyne, etc., and halogenated hydrocarbons such as methyl fluoride, ethyl fluoride, propyl fluoride, methyl chloride, ethyl chloride, methyl bromide, ethyl bromide, methyl iodide, difluoromethane, dichloromethane, hexafluoroethane, etc. These compounds may be used solely or as a mixture thereof.

The preferred composition ratio of the surface barrier layer mainly composed of carbon and silicon is from 0.4 to 0.9, and preferably less than 0.75 in C/Si+C. It is necessary, in this invention, that the content of carbon in the barrier layer is less than the content of carbon in the surface improvement layer. The surface barrier layer containing mainly carbon and silicon can be formed according to the method described, for example, in Japanese Patent Application (OPI) No. 115556/82.

In the surface barrier layer mainly containing nitrogen and silicon, the content of nitrogen atoms is preferably from 25 to 55 atomic %, and more preferably from 35 to 55 atomic %. The surface barrier layer containing mainly nitrogen and silicon can be formed according to the method described in, for example, Japanese Patent Application (OPI) No. 58160/82.

The content of oxygen atom in the surface barrier layer mainly containing oxygen and silicon is preferably 40 to 65 atomic %. The barrier layer can be formed according to the method described in, for example, Japanese Patent Application (OPI) No. 63546/82.

An electrophotographic photosensitive material utilizing a photoconductive layer composed of amorphous silicon as a photosensitive material is fundamentally composed of a conductive support and a photoconductive layer composed of amorphous silicon containing silicon atoms and hydrogen atoms formed on the support, and the structure and methods for production thereof are known.

In a practical example of a method of producing the above-described structure, an amorphous silicon photoconductive layer is formed on a sheet of a conductive metal such as aluminum, chromium, iron, etc., or an alloy thereof (e.g., stainless steel, etc.) from a compound containing silicon and hydrogen or a mixture of these compounds by utilizing glow discharging, a sputtering method, a chemical vapor deposition method, an ion plating method, etc.

Hereinafter, the invention will be explained by referring to the case of producing an electrophotographic photosensitive material by utilizing a glow discharging method, which is a typical production method for producing an electrophotographic photosensitive material utilizing an amorphous silicon photoconductive layer as a photosensitive material.

A method for forming an amorphous silicon photoconductive layer utilizing glow discharging is generally composed of the step of decomposing a gaseous compound such as silane containing silicon atom and hydrogen atom (and/or halogen atom) or a silane derivative by applying thereto glow discharging while contacting the gaseous compound with a conductive support, whereby amorphous silicon is formed on the support.

Examples of silane and silane derivatives are monosilane, disilane, trisilane, tetrasilane, silicoethylene, silicoacetylene, disiloxane, silylamine, monochlorosilane, dichlorosilane, trichlorosilane, tetrachlorosilane, hexachlorodisilane, octachlorotrisilane, decachlorotetrasilane, dodecachloropentasilane, monofluorosilane, difluorosilane, trifluorosilane, tetrafluorosilane, hexafluorodisilane, octafluorotrisilane, monobromosilane, dibromosilane, tribromosilane, tetrabromosilane, hexabromosilane, octabromosilane, monoiodosilane, diiodosilane, triiodosilane, tetraiodosilane, hexaiodosilane, octaiodosilane, and a compound containing silicon atom and two or more halogen atoms in one molecule (e.g., $SiBrCl_3$, $SiCl_2F_2$, etc.). These compounds may be used solely or as a mixture thereof, and may also, if desired, be used with hydrogen gas.

In an example of a method of forming an amorphous silicon layer on the surface of a conductive support by decomposition the aforesaid silicon-containing compound by glow discharging, a conductive support having a cleaned surface is placed in a highly closed container such as a bell jar, after reducing the pressure in the container, glow discharging is performed at the surface of the conductive support, whereby the gases adsorbed on the surface of said support are removed, a silicon-containing compound such as monosilane ($SiH_4$) is introduced into the container, and glow discharging is performed at the surface of the support under high vacuum to decompose the silicon-containing compound, whereby an amorphous silicon layer is formed on the surface of the support. The thickness of the photoconductive layer composed of the amorphous silicon thus formed is usually in the range of 5 to 100 $\mu$m.

The invention will now be illustrated by the following example.

EXAMPLE 1

The following operation was performed using a glow discharging apparatus for producing amorphous silicon of a bell jar type equipped with an evacuating system, a gas supply conduit system, gas leak system, a heater, a glow discharging device, etc.

An aluminum drum (support, outer diameter: 120 mm, length: 410 mm) having a polished surface was set on a quartz rotary table in the bell jar and the inside air in the bell jar and in the gas conduit system of the bell jar was evacuated to reduce the pressure in the system to about $3\times10^{-5}$ torr (mm Hg).

Then, the aluminum drum was heated to 250° C. by means of the heater equipped in the bell jar. In addition, the temperature was controlled by measuring the temperature of the drum by means of an alumel-chromel thermocouple.

Then, the leak valve of the bell jar was opened a little to control the pressure in the bell jar to about 0.3 torr and glow discharging of 30 watts was performed for 5 minutes between the aluminum drum and a gas-blowing plate by a negative pulse high voltage source (hereinafter referred to simply as a high voltage source) to remove gases adsorbed on the surface of the drum. After cutting off the high voltage source and closing the leak valve, the pressure in the bell jar was reduced again to about $1\times10^{-5}$ torr.

Then, $B_2H_6$ diluted with 290 ppm by volume of hydrogen (hereinafter referred to as $B_2H_6/H_2$) was supplied into the container through the gas supply conduit system at a flow rate of 4 cc/min (standard cubic centimeter per minute, SCCM) while controlling the flow rate by means of a mass flow meter. Also, by slowly opening the valve for an $SiH_4$ gas supply conduit system, $SiH_4$ was supplied at a flow rate of 150 cc/min, while controlling the flow rate by means of a mass flow meter. In addition, in this operation, the inside pressure of the bell jar was adjusted to $4.5\times10^{-1}$ torr by controlling a bypass valve.

When the flow rate of the supplied gases became constant, glow discharging of 100 watts in inlet electric power and 100 Hz in pulse current was performed for 5 hours between the rotary drum and the gas blowing plate, to thereby form an amorphous silicon photoconductive layer.

Then, prior to initiating the formation of a barrier layer, the gas supplying conduit system was closed and the pressure in the bell jar was reduced again to $1\times10^{-5}$ torr.

When the pressure in the bell jar became $1\times10^{-5}$ torr, by adjusting the mass flow meter for the $SiH_4$ gas supplying conduit system and the mass flow meter for the $C_2F_6$ gas supplying conduit system to 30 cc/min and 8 cc/min., respectively, these gases were supplied into the bell jar. Then, when the pressure in the bell jar became $5\times10^{-3}$ torr, the mass flow meter for the $SiH_4$ gas supplying conduit system and the mass flow meter for the $C_2F_6$ gas supplying conduit system were adjusted to 60 cc/min and 40 cc/min, respectively. When the flow rates of these gases became constant, the pressure in the bell jar was adjusted to $4.5\times10^{-1}$ torr by utilizing the bypass valve.

Then, glow discharging of 100 watts was performed for 6 minutes by a high voltage source to form a barrier layer.

After cutting off the high voltage source to stop the glow discharging, when the pressure in the bell jar became $5\times10^{-2}$ torr, the pressure was further reduced to $1\times10^{-5}$ torr, the evacuation was further continued for another 10 minutes. Then, the heater was cut off and while controlling the temperature of the drum to 160° C., hydrogen gas was supplied into the bell jar through the gas supplying conduit system at a flow rate of 40 cc/min, which was controlled by the mass flow meter. Then, the valve for the $C_2F_6$ gas supplying conduit system was slowly opened, and $C_2F_6$ gas was supplied at a flow rate of 40 cc/min while controlling the flow rate by means of the mass flow meter, and further a monosilane gas was supplied at a flow rate of 16 cc/min. In this operation, the pressure in the bell jar was maintained at $4.5\times10^{-1}$ torr by controlling the bypass valve.

When the flow rates of the supplied gases became constant, glow discharging was performed for 20 minutes between the rotary drum and the gas blowing plate by applying at a.c. field of an inlet power of 50 watts and 100 KHz to form a surface improvement layer.

Then, after cutting off the high voltage source to stop the glow discharging, when the pressure in the bell jar became $5\times10^{-2}$ torr, the pressure was further reduced to $1\times10^{-5}$ torr and the evacuation was further continued for another 10 minutes. Then, the heater was cut, and when the temperature became 100° C., the drum was withdrawn from the bell jar. Thus, a photosensitive material (A) was obtained.

Then, by following the same procedure as in the aforesaid case for preparing photosensitive material (A), except that in the case of forming the surface improvement layer, the gases were supplied at a flow rate of 40 cc/min for $C_2F_6$, 40 cc/min for hydrogen gas, and 45 cc/min for monosilane gas, a photosensitive material (B) was prepared. Also, by following the same procedure as in the case of producing photosensitive material (A) except that a surface improvement layer was not formed, a photosensitive material (C) was prepared.

The value of carbon/carbon+silicon (atomic %) of the surface improvement layers of the above-described photosensitive materials (A) and (B) was 84% and 66%, respectively. The content of fluorine atom was 5% of the total numbers of atom in both the samples.

Also, after forming the amorphous silicon photoconductive layer as in photosensitive material (A) and reducing the pressure in the bell jar to $1\times10^{-5}$ torr, $SiH_4$ gas diluted by $H_2$ to 10 vol% ($SiH_4/H_2$) and an $N_2$ gas were supplied into the bell jar at a flow rate ratio of 1/10 until the pressure in the bell jar became $1\times10^{-2}$ torr. When the pressure in the bell jar became constant, the valve of the inflow pipe was adjusted so that a Pirani gauge for the inflow pipe became 0.5 torr and flow discharging was performed for 1 minute to form a barrier layer.

Then, on the barrier layer thus formed was further formed a surface improvement layer as in photosensitive material (A) to provide a photosensitive material (D).

Also, by following the same procedure as in the case of producing photosensitive material (A), except that in the case of forming the surface improvement layer of photosensitive material (A), a $CH_4$ gas was introduced into the bell jar at a flow rate of 80 cc/min in place of introducing a $C_2F_6$ gas at a flow rate of 40 cc/min, a photosensitive material (E) was prepared.

Each of photosensitive materials (A), (B), (C), (D) and (E) thus prepared was charged by corona discharging at a positive voltage of 6 kv and a charging time of 0.08 sec. under a temperature of 30° C. and a relative humidity of 85% and then immediately imagewise exposed at 1.5 lux·sec. Also, the latent image thus formed on the surface of the photosensitive drum was developed with a dry developer composed of negatively charged toner and carrier by a magnetic brush method and the toner image was transferred onto a transfer paper by applying positive corona discharging, whereby a very sharp image having a high resolving power and high density was obtained.

Then, each of the photosensitive materials (A), (B), (C), (D) and (E) was subjected to a corona charging deterioration test at a temperature of 30° C. and a relative humidity of 85% as follows. Each of the photosensitive materials (A), (B), (C), (D) and (E) was mounted in a rotary charging test device and after performing corona discharging for 10 minutes or 30 minutes by applying a negative voltage of 6 kv while rotating at 40 rpm, a copy image was formed by following the same image-forming process as above. The resolving power of each image thus formed was measured and the results thus obtained are shown in Table 1.

TABLE 1

| Resolving Power after Negative Corona Charging | | | | |
|---|---|---|---|---|
| | Negative Corona Charging | | C/C + Si (atomic %) | |
| Sample | 10 Min. | 30 Min. | Barrier Layer | Improvement Layer |
| A* | 6 | 6 | 57 | 84 |
| B** | 2 | 0 | 57 | 66 |
| C** | 0 | 0 | 57 | |
| D* | 6 | 6 | 50 (N/N + Si) | 84 |

TABLE 1-continued

| Resolving Power after Negative Corona Charging | | | | |
|---|---|---|---|---|
| | Negative Corona Charging | | C/C + Si (atomic %) | |
| Sample | 10 Min. | 30 Min. | Barrier Layer | Improvement Layer |
| E* | 4 | 2 | 57 | 87 |

*Sample of this invention
**Comparison Example

The numerals in Table 1 are the distinguishable number of lines in 1 mm.

In 10 minutes photosensitive material subjected to corona discharging 400 times which corresponds to electrophotographic operations for obtaining 100–400 copy sheets.

As shown in Table 1, in the photosensitive materials (A), (D) and (E) of this invention having the surface improvement layers according to the invention, the reduction of resolving power after negative corona charging under the atmosphere of 30° C. and 85% in relative humidity could be sufficiently prevented, but in the comparison examples, the resolving power was reduced.

Similarly, the corona charging deterioration test was performed at positive voltage of 6 kv using the same rotary charging device. The results are shown in Table 2.

TABLE 2

| Resolving Power after Positive Corona Charging | | | |
|---|---|---|---|
| | Positive Corona Charging | | |
| Sample | 10 Min. | 30 Min. | 60 Min. |
| A* | 6 | 6 | 6 |
| B** | 4 | 2 | 0 |
| C** | 2 | 0 | 0 |
| D* | 6 | 6 | 6 |

*, **and the numerals in Table 2 are the same as in Table 1.

As shown in Table 2, the photosensitive materials of this invention show no reduction in resolving power even after positive corona charging under severe conditions, which shows that the photosensitive materials of this invention are excellent.

While the invention has been described in detail and with reference to specific embodiments thereof, it will be apparent to one skilled in the art that various changes and modifications can be made therein without departing from the spirit and scope thereof.

What is claimed is:

1. An electrophotographic photosensitive material comprising a conductive support having thereon, in succession, a photoconductive layer composed of an amorphous silicon containing silicon atoms and hydrogen atoms and a barrier layer mainly composed of silicon and a further element selected from the group consisting of carbon, nitrogen and oxygen and further on the barrier layer a surface improvement layer having a composition of carbon and silicon of from 0.70/1 to 0.95/1 by atomic ratio in carbon/carbon+silicon, and said composition ratio being larger than that of the barrier layer.

2. An electrophotographic photosensitive material as in claim 1, wherein said surface improvement layer has a thickness of from the thickness corresponding to a monomolecular layer to 30 μm.

3. An electrophotographic photosensitive material as in claim 1, wherein said surface improvement layer contains fluorine atoms.

4. An electrophotographic photosensitive material as in claim 1, wherein said surface improvement layer contains fluorine atoms in an amount of from 1 to 30% of the total number of atoms.

5. An electrophotographic photosensitive material as in claim 1, wherein the barrier layer is mainly composed of carbon and silicon and the ratio of carbon/carbon+-silicon is from 0.4/1 to 0.9/1.

6. An electrophotographic photosensitive material as in claim 1, wherein the barrier layer is mainly composed of nitrogen and silicon and the content of nitrogen atoms is from 25 to 55 atomic %.

7. An electrophotographic photosensitive material as in claim 1, wherein the barrier layer is mainly composed of oxygen and silicon and the content of the oxygen atoms is from 40 to 65 atomic %.

* * * * *